US005775530A

United States Patent [19]

Attaway

[11] Patent Number: 5,775,530

[45] Date of Patent: Jul. 7, 1998

[54] METHOD OF AND APPARATUS FOR PROTECTING FRAGILE OBJECTS

[76] Inventor: Joel Attaway, 25615 99th Ave., East, Graham, Wash. 98338

[21] Appl. No.: 540,243

[22] Filed: Oct. 5, 1995

[51] Int. Cl.[6] ..... B65D 6/28; B65D 81/02; B65D 81/03

[52] U.S. Cl. ..... 220/4.22; 53/441; 53/472; 206/591; 220/4.24; 220/902

[58] Field of Search ..... 220/4.24, 4.06, 220/4.07, 4.04, 4.09, 4.22, 4.23, 902, 903, 461, 904; 206/591, 592, 594, 584; 150/154, 161, 165; 53/471, 472; 229/4.5

[56] References Cited

U.S. PATENT DOCUMENTS

| | | | |
|---|---|---|---|
| 991,327 | 5/1911 | La Fave | 220/4.06 |
| 2,375,101 | 5/1945 | Gibbs | 220/904 X |
| 3,092,277 | 6/1963 | Brim | 220/4.24 X |
| 3,135,456 | 6/1964 | Palazzolo | 220/4.22 X |
| 3,905,511 | 9/1975 | Groendal | 220/902 X |
| 4,228,908 | 10/1980 | Tweeton | 220/902 X |
| 4,566,055 | 1/1986 | Klees et al. . | |
| 4,569,082 | 2/1986 | Ainsworth et al. | 206/594 X |
| 4,577,474 | 3/1986 | Peterson | 220/903 X |
| 4,681,225 | 7/1987 | Schuster | 206/591 X |
| 5,183,953 | 2/1993 | Anderson et al. | 150/154 X |
| 5,199,563 | 4/1993 | Goodman | 206/592 X |
| 5,251,460 | 10/1993 | DeMarco et al. | 220/903 X |
| 5,515,971 | 5/1996 | Segrest | 206/591 X |

OTHER PUBLICATIONS

Forty Below, Ltd. brochure entitled: "Climbing Equipment for the Extremes"; Copyright 1995.

Forty Below, Ltd. brochure entitled: "Brewing Equipment for the Extremes"; Copyright 1995.

*Primary Examiner*—Allan N. Shoap
*Assistant Examiner*—Niki M. Kopsidas
*Attorney, Agent, or Firm*—Wigman, Cohen, Leitner & Myers, P.C.

[57] ABSTRACT

A method of and apparatus for protecting fragile objects from breakage which utilizes a case formed from upper and lower portions having dimensions somewhat smaller than the fragile object to be protected which is used to encase that object and provide cushioning for the fragile object should it be dropped or jostled.

14 Claims, 1 Drawing Sheet

METHOD OF AND APPARATUS FOR PROTECTING FRAGILE OBJECTS

BACKGROUND OF THE INVENTION

The present invention is directed to method of and apparatus for protecting fragile objects which are susceptible to breakage. More particularly, the present invention is directed to a method of and apparatus for protecting a candle lantern having a metal and glass structure for carrying a candle for use in outdoor activities such as hiking and camping.

Oftentimes, while participating in outdoor activities such as hiking and camping, the hiker or camper desires to remain outdoors after sundown or even overnight. Under such circumstances, it is useful to have a source of light in order to assist in the various chores as well as other enjoyable activities in which hikers and campers participate outdoors after sundown. However, when participating in hiking and camping activities in which the sole equipment available to the hiker or camper is that equipment which he carries with him during hiking or camping trips, it is desirable to carry a small, lightweight and compact source of light which can readily be taken from the hiker's or camper's backpack and quickly set up to provide the desired illumination. One such device is manufactured by Uco, Inc. of Redmond, Wash., which has been granted U.S. Pat. No. 4,566,055.

The candle lantern that is available from Uco, as disclosed in the cited United States Patent, is formed from a metal case which is designed to hold a glass globe in which a wax, paraffin or other similar type of lightweight candle is secured in order to shield it from wind and other adverse environmental conditions. Even though the candle lantern is formed with a integral metal case for protecting the glass globe, it has been found that the candle lantern is frequently susceptible to being dropped, given that it is often being unpacked from the user's backpack in the dark in unknown terrain. Typically, when such a candle lantern is dropped by the user from heights of over 1 foot onto concrete or about 2–3 feet over hard-packed earth or a combination of earth and stones, the glass globe breaks. In addition, even though the candle lantern may be carried within the user's backpack, backpacks are subject to striking various objects or being dropped themselves, which can likewise result in breakage of the glass globe of the candle lantern. It should be noted that, when the glass globe of the candle lantern breaks inside of the owner's backpack, it is difficult to extract all of the small pieces of sharply edged glass that the glass globe breaks into, without injuring the owner. Also, as will be obvious to those who have hiking and/or camping experience, once the glass globe of the candle lantern is broken, the candle lantern generally cannot be used reliably, due to wind and other adverse environmental conditions.

SUMMARY AND OBJECTS OF THE INVENTION

In view of the foregoing, there obviously is a need in the art for a method of and apparatus for protecting a candle lantern and other fragile objects such that they are not easily broken. That is especially true for fragile objects which are used outdoors by hikers and campers who must carry all of their equipment with them during those activities.

Therefore, it is a primary object of the present invention to provide a method of and apparatus for protecting a candle lantern and especially the glass globe of a candle lantern from breakage which adds very little weight to the candle lantern yet provides a great degree of breakage protection for the glass globe of the candle lantern.

It is yet another object of the present invention to provide a method of and apparatus for protecting a candle lantern or other fragile object which, in addition to being lightweight, is inexpensive to manufacture and may be easily used with the candle lantern or other fragile object.

It is yet another object of the present invention to provide a method of and apparatus for protecting a glass globe of a candle lantern or other fragile object in which the candle lantern or other fragile object may be readily placed within a protective covering and in which the protective covering may readily be removed from the candle lantern or other fragile object when the use of that candle lantern or other fragile object is desired.

It is a still further object of the present invention to provide a method of and apparatus for protecting a fragile object which provides protection for that fragile object without requiring the use of cumbersome connectors or other closure devices.

The foregoing objects and advantages are accomplished by the present invention in its method aspects by providing a case or capsule formed from a neoprene material in a specific shape such that it is designed to firmly adhere to the contours of the candle lantern or other fragile object in order to provide protection from breakage for the candle lantern globe or other fragile object by essentially enveloping the entire candle lantern or other fragile object within its confines. In that manner, when the candle lantern or other fragile object is dropped, for example, from a height of 3 feet onto a concrete surface, the glass globe of the candle lantern or other fragile object is adequately cushioned and is able to avoid breakage.

In its apparatus aspects, the present invention provides a cylindrically shaped capsule or case formed from two different sizes of neoprene material, one size for each end piece and a thicker size for the sides of the cylindrically shaped case. A slit in the sides of the case extending approximately 270–330 degrees around the circumference of the cylindrically shaped case is provided such that the case can be opened by pivoting the top and bottom portion in such a manner that the candle lantern can be easily inserted and removed.

With these and other objects, advantages and features of the invention that may become hereinafter apparent, the nature of the invention may be more clearly understood by reference to the following detailed description of the invention, the appended claims and to the several drawings attached herein.

DETAILED DESCRIPTION OF THE PREFERRED EMBODIMENT

Figure 1:
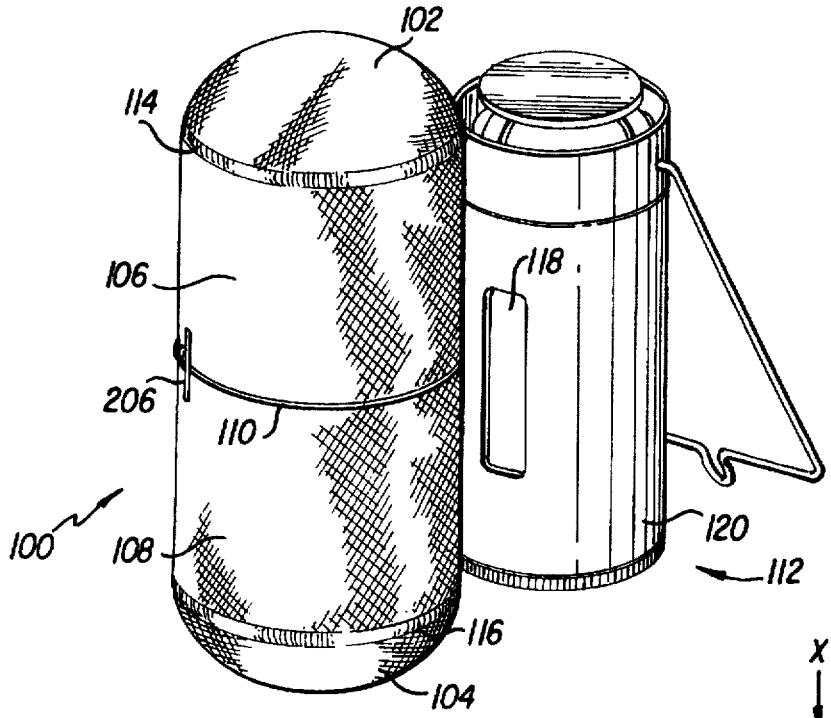
FIG. 1 is a drawing of a perspective view of the apparatus of the present invention as well as a candle lantern which it is designed to protect.

Referring now in detail to the drawings wherein like parts are designated by like reference numerals throughout, there is illustrated in FIG. 1 the case 100 for protecting fragile objects which is the subject of this invention. The case 100 is formed from neoprene foam encapulsated by nylon on either side and is generally made up of an upper portion 106 and a lower portion 108. Each of the upper and lower portions 106, 108 of the case 100 is preferably made from 0.25 inch neoprene, which is die cut to the proper rectangular dimensions. The upper and lower portions 106, 108 of the case 100 each include a respective end piece 102, 104. The end pieces 102, 104 are die cut in a circular shape from preferably 0.1875 inch neoprene and are secured to the respective upper and lower portions 106, 108 by means of glueing as well as stitching 114 and 116. Such stitching 114, 116 secures the respective end pieces 102 and 104 to their respective upper and lower portions 106, 108 of the case 100 in a secure fashion as well as forming rounded or domed ends to the upper and lower portions 106, 108 of the case 100. A slit 110 is provided in the case 100 where the upper and lower portions 106, 108 of the case meet.

The candle lantern 112 having a glass globe 118 which is designed to be protected from breakage by the case 100 is also shown in FIG. 1, in its closed position. In its opened position, the glass globe 118 is positioned above the metal case 120 of the candle lantern 112. See U.S. Pat. No. 4,566,055.

Figure 2:
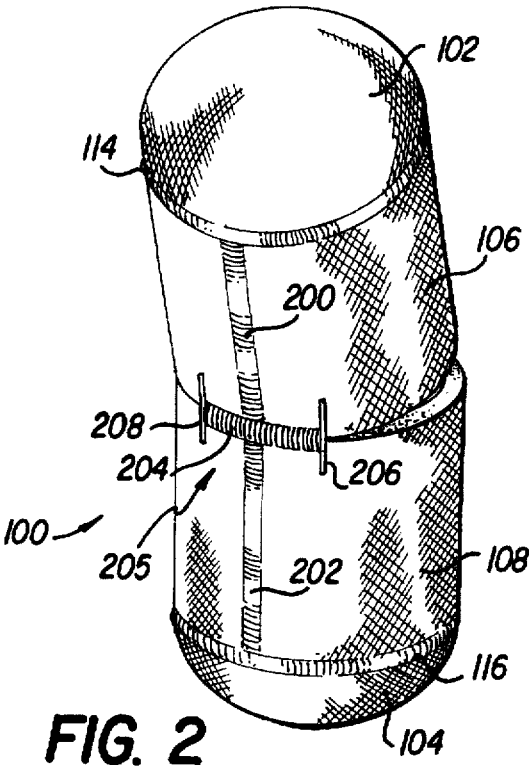
FIG. 2 is a drawing of a rear perspective view of the apparatus of the present invention showing the hinge which secures the upper and lower portions of the case.

FIG. 2 shows details of the hinge 205 which secures the upper and lower portions 106, 108 of the case of the present invention together such that each of the upper and lower portions 106, 108 of the case 100 can pivot with respect to each other about the hinge 205. The main pieces which form the upper and lower portions 106, 108 of the case 100 are rectangular in shape and are formed into cylindrical shapes by means of the respective stitching 200, 202 which forms the each rectangular piece into the cylindrical shape of the upper and lower portions 106, 108 of the case 100 (without the end pieces 102, 104). The seams where they are stitched together may also be glued.

The upper and lower portions 106, 108 of the case 100 (with the attached end pieces 102,104) are formed into the case 100 by gluing the upper and lower portions 106, 108 in the vicinity of where the hinge 205 is to be formed, as well as using stitching 204 to additionally secure the upper and lower portions 106, 108 of the case 100 together. The hinge 205 may be preferably be of a length such that it consumes between 30 and 90 degrees of the circumference of the case 100. In order to provide additional strength, the upper and lower portions 106, 108 are vertically stitched together by vertical stitching 206, 208.

Figure 3:
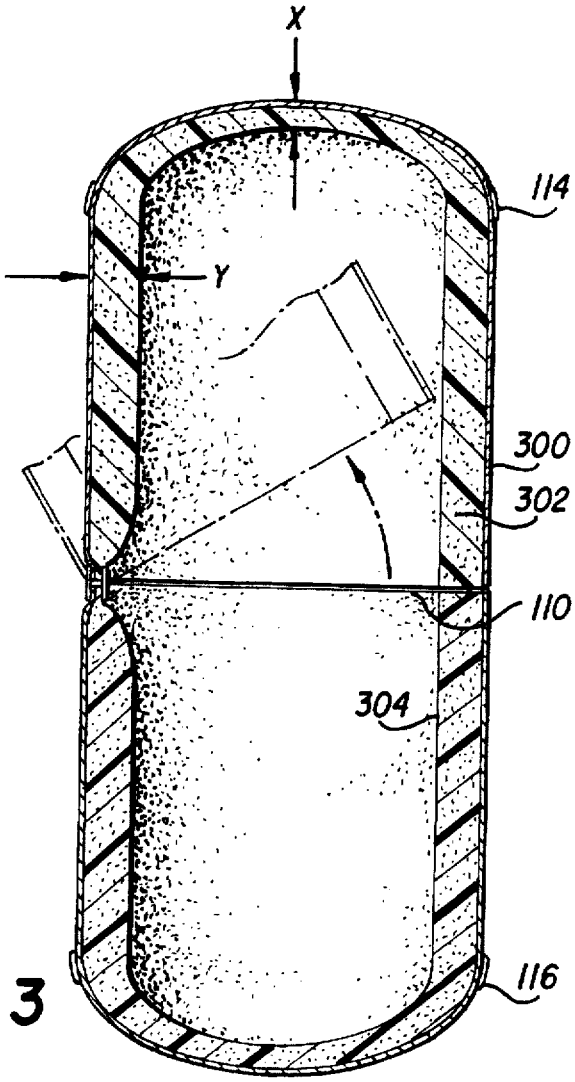
FIG. 3 is a drawing of a side cross-sectional view of the apparatus of the present invention.

FIG. 3 illustrates a view of a cross-section of the case 100, showing the neoprene material 302 covered on the outside by a preferably colored nylon material 300 and also on the inside by a preferably nylon material 304. The X-dimension of the domed end 102 of the upper portion 106 may preferably be 0.1875 inches in thickness. The Y-dimension of the side wall of the upper portion 106 of the case 100 may preferably be 0.25 inches in thickness. The respective corresponding elements of the lower portion 108 of the case 100, as previously described, have the same dimensions.

As also previously described, once the upper and lower portions 106, 108 of the case 100 are secured together by means of the hinge structure 205 described above, the case 100 contains a slit 110 which preferably occupies between 270 and 330 degrees of the circumference of the case 100. In order to insert the candle lantern 112 into the case 100, the upper and lower portions 106, 108 are separated from each other along the slit 110 by pivoting them along the hinge 205. The candle lantern 112 or other fragile object is then inserted into first one of the upper or lower portions 106, 108 of the case 100.

It should be noted that the inside dimensions of the case 100 are smaller than the outside dimensions of the candle lantern 112 such that, when the candle lantern 112 is inserted into the case 100, is causes the neoprene material from which the case is made to stretch and thus to fit snuggly and securely around the candle lantern 112. By holding the candle lantern 112 in that manner, the case 100 reduces the dynamic shock load on the candle lantern 112 (that is, the "bounce effect"). That is accomplished by placing the neoprene material which forms the case 100 under stress by designing the case 100 to have a smaller inside dimension than the outside dimension of the object being protected.

After the candle lantern 112 has been fitted into one of the upper or lower portions 106, 108 of the case 100, the remaining portion 106, 108 of the case 100 is stretched over the still uncovered portion of the candle lantern 112 such that it, too, fits snuggly and securely over the candle lantern and provides protection from breakage for the glass globe 118 of the candle lantern 112. The case 100 thus encloses or covers virtually the entire candle lantern 112.

It has been found that, when using the method and apparatus of the present invention to protect the glass globe 118 of the candle lantern 112, the case 100 containing the candle lantern 112 may dropped at an angle from a height of 4 feet or less onto a concrete pad with no damage to the glass globe 118 of the candle lantern 112. In addition, using the method and apparatus of the present invention, a vertical drop from 3 feet onto a concrete pad can also be withstood without damage to the glass globe 118 of the candle lantern 112. However, when the candle lantern 112 without the case 100 is dropped from a height of only 1 foot onto a concrete pad, the glass globe 118 has been found to break. In the event that the candle lantern 112 as encased within the case 100 of the present invention falls from a height sufficient to break the glass globe 118, it is easy to clean the broken glass out of the case 100, since the broken glass pieces do not adhere to the nylon inner lining 304 of the case 100.

Although only a preferred embodiment is specifically illustrated and described herein, it will be appreciated that many modifications and variations of the present invention are possible in light of the above teachings and within the preview of the appended claims without departing from the spirit and intended scope of the invention. In particular, the method and apparatus of the present invention may be utilized with fragile objects of different sizes and configurations, it merely being necessary to design case having slightly smaller dimensions than the outside of the object to be protected. Also, while neoprene of certain thicknesses has been disclosed for use with the instant method and apparatus, other dense but cushioning materials could likewise be utilized, to the same effect. For example, the case 100 could also be made from injection molded foam and could be formed as a single piece or as two or more pieces.

I claim:

1. A method of protecting a fragile object from breakage, comprising the steps of:

forming a case in the shape of said fragile object having inside dimensionssmaller than said fragile object;

said case being formed such that it has top and bottom portions of substantially equal size which are flexibly movable with respect to each other about a binge formed by stitching juxtaposed portions of said top and bottom portions;

moving said top and bottom portions away from each other said inserting said fragile object into one of said top and bottom portions such that said one of said top and bottom portions stretches around said fragile object to form a snug fit around said fragile object;

pivoting said other one of said top and bottom portions towards the other one of said top and bottom portions and stretching said other one of said top and bottom portions over said fragile object such that at least one inside dimension of said at least one top and bottom portions is increased, thereby forming a snug fit over and around said fragile object; and said top and bottom portions covering essentially said entire fragile object.

2. The method of claim 1, wherein said case is formed from a stretchable cushioning material.

3. The method of claim 2, wherein said stretchable cushioning material is neoprene.

4. The method of claim 1, wherein said case has an outer circumference and an opening separates said top and bottom portions of said case between about 270–330 degrees of said outer circumference.

5. Apparatus for protecting a fragile object from breakage, comprising:

a first rectangular shaped piece having two ends which are fastened together to form a first cylindrically shaped piece;

a second rectangular shaped piece having two ends which are fastened together to form a second cylindrically shaped piece;

a first round piece which is fastened to said first cylindrically shaped piece in a manner such that a first cylinder having a closed domed end is formed, said first closed end cylinder forming a top portion of said apparatus, a second round piece which is fastened to said second cylindrically shaped piece in a manner such that a second cylinder having a closed domed end is formed, said second closed end cylinder forming a bottom portion of said apparatus;

a hinge joint formed by stitching juxtaposed portions of said top and bottom portions opposite the first and second closed ends, such that said top and bottom portions are flexibly movable with respect to one another; and said top and bottom portions of said apparatus being of substantially equal size and being formed from a flexible cushioning material.

6. The apparatus of claim 5, wherein said top and bottom portions have inner dimensions smaller than said fragile object to be protected from breakage.

7. The apparatus of claim 5, wherein each of said first and second rectangular and said first and second round pieces have a thickness and said first and second rectangular pieces have a thickness greater than said first and second round pieces.

8. The apparatus of claim 5, wherein each of said first and second rectangular and first and second round pieces are formed from neoprene.

9. A method of carrying a fragile object in such a manner that it is substantially prevented from breakage, comprising the steps of:

forming a case for said fragile object having substantially the shape of said fragile object, said case having inside dimensions smaller than said fragile object;

said case being formed with two substantially equal size movable portions which are flexibly hinged to each other about a hinge formed by stitching juxtaposed portions of said two movable portions such that said two movable portions may be flexibly moved with respect to one another;

separating said two movable portions away from each other while inserting said fragile object into one of said two movable portions;

stretching said one of said two movable portions into which said fragile object is inserted such that said one of said two movable portions snugly holds that portion of said fragile object placed in it;

pulling the remaining one of said two movable portions over said fragile object and stretching said remaining one of said two movable portions such that it snugly fits over and holds said fragile object being covered thereby; and removably covering essentially said entire fragile object with said two movable portions.

10. The method of claim 9, wherein said two movable portions are manufactured from a stretchable cushioning material.

11. The method of claim 10, wherein said stretchable cushioning material is neoprene.

12. The method of claim 9, wherein the flexible hinge formed between said two movable portions is formed by securing a small part of each of said two movable portions together.

13. The method of claim 9, wherein said case has an outer circumference and an opening separates said two movable portions of said case between about 270–330 degrees of said outer circumference.

14. The method of claim 9, wherein said step of forming said case with two movable portions includes forming each of said two movable portions from material having different thickness.

* * * * *